United States Patent [19]

Gould et al.

[11] Patent Number: 4,823,912

[45] Date of Patent: Apr. 25, 1989

[54] MULTIPURPOSE LADDER FIXTURE

[76] Inventors: William E. Gould, 12981 Gambusa Way, San Diego, Calif. 92129; Richard J. Gould, 78 Pequot Trail, Medford, N.J. 08055; Steven P. Gould, 107 Chatham Rd., Mount Laurel, N.J. 08054

[21] Appl. No.: 203,131

[22] Filed: Jun. 6, 1988

[51] Int. Cl.[4] ..... E06C 7/48

[52] U.S. Cl. ..... 182/214; 182/107; 248/210

[58] Field of Search ..... 182/214, 107, 108, 111; 248/210

[56] References Cited

U.S. PATENT DOCUMENTS

| | | | |
|---|---|---|---|
| 2,680,554 | 6/1954 | Dakin | 182/214 |
| 2,722,360 | 11/1955 | Malm . | |
| 2,797,037 | 6/1957 | Niedojadlo . | |
| 2,806,642 | 9/1957 | Miele | 182/214 |
| 2,993,562 | 7/1961 | Hussey . | |
| 3,288,249 | 11/1966 | Gibson . | |
| 3,419,109 | 12/1968 | Costlow | 182/214 |
| 3,486,580 | 12/1969 | Nameche et al. . | |
| 3,910,378 | 10/1975 | Nyman | 182/214 |
| 4,061,203 | 12/1977 | Spencer et al. . | |
| 4,339,020 | 7/1982 | Wiseman | 182/214 |
| 4,444,291 | 4/1984 | McPherson . | |
| 4,458,783 | 7/1984 | Stakes | 248/210 |
| 4,502,566 | 3/1985 | Wing . | |
| 4,580,660 | 4/1986 | Oling | 248/210 |
| 4,754,842 | 7/1988 | Southern | 182/214 |

*Primary Examiner*—Reinaldo P. Machado
*Attorney, Agent, or Firm*—Howson and Howson

[57] ABSTRACT

A multipurpose, two-position ladder attachment for extending a ladder above overhanging roofs while bridging the eaves and gutters, for leaning against weak siding, and for installing heavy or bulky panels or windows in elevated openings. Elongated channels formed in two cantilevered brackets are clamped about the stiles of the ladder by a rod and wing nuts. The rod passes through hollow rungs of the ladder or in close proximity to the stiles if the rungs are not hollow. A flat padded board connected across the free ends of the brackets is positionable with its broad side horizontal or vertical when the ladder is leaned at a recommended angle.

18 Claims, 4 Drawing Sheets

FIG. 1
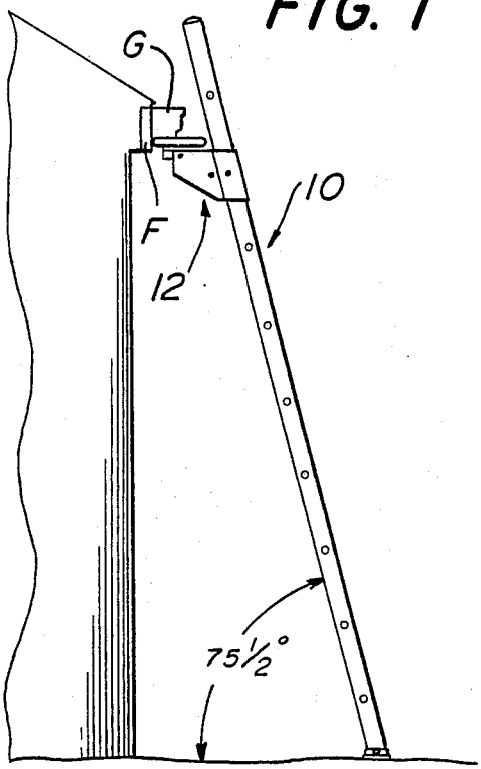
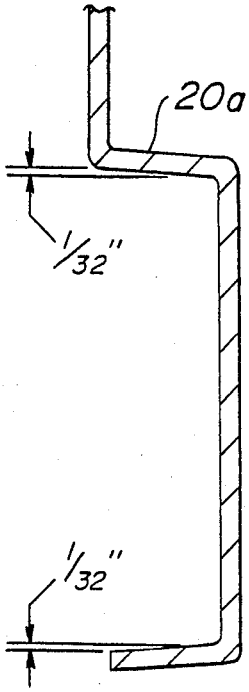
FIG. 5
FIG. 2
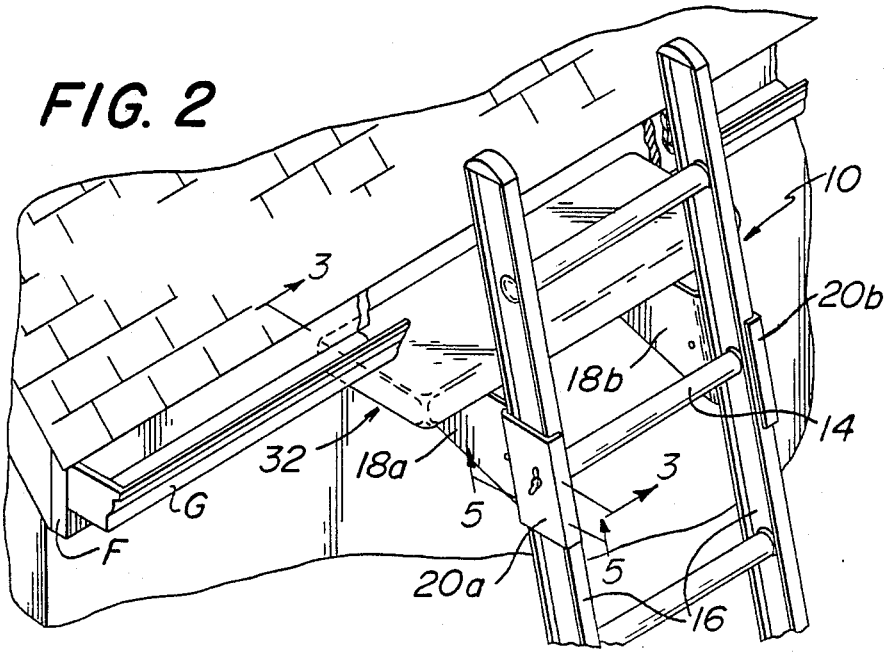

MULTIPURPOSE LADDER FIXTURE

BACKGROUND OF THE INVENTION

The present invention relates to wall stand-off fixtures for ladders, and more particularly to an easily attachable multipurpose fixture for bridging a ladder over projecting structures, buffering a ladder leaned against fragile surfaces, and interim support of elevated structural materials.

Various configurations of ladder attachments have been used or proposed to enable a ladder leaned against the side of a building to extend above an overhanging roof without touching fragile roof tiles or rain gutters. Some of these devices also include bumpers with resilient padding for leaning against fragile aluminum or vinyl siding. For instance, brackets may be clamped near the upper ends of the stiles of the ladder to provide a stand-off from any overhanging eave or gutter. Nonskid pads on the bearing ends of the brackets resist side slip of the ladder as well as reduce the risk of damaging thin gauge aluminum or vinyl siding. However, on smooth or wet surfaces, the possibility of side slip is substantially increased. Even with a ladder leaned at the Occupational Safety and Health Agency (OSHA) recommended 75½ degrees angle above the horizontal, the horizontal component or leaning force of the ladder, with or without a worker standing on it, is only about one-fourth of the total weight. Consequently, the static friction at the ladder-wall interface is also low. The instability is particularly hazardous when a worker is stepping back onto a ladder from the edge of a roof since his or her weight is not contributing to the leaning and friction forces until the worker is totally supported on the ladder. Side slip may be prevented by securing the brackets to the structure with nails or other fasteners, but this is often not possible or practical where there is finished siding or the ladder must be frequently moved.

When installing a heavy wall panel or window assembly in a high opening, wall stand-off brackets are sometimes used on a ladder to allow the worker to stand near the top rung and set the panel or assembly without interference from the stiles. The panel or assembly is pushed up the ladder along the stiles and supported either by the worker or another from above until it is set in place. The stand-off brackets are not equipped to rest the panel or window near the top of the ladder before it is placed in the opening.

SUMMARY OF THE INVENTION

Accordingly, it is an object of the present invention to provide a multipurpose ladder fixture which will enable a ladder to be safely extended above an overhanging roof of a building while bridging the eave and gutter; which will enable a ladder to be leaned against upright structure without risk of damaging fragile surfaces; and which will provide support for heavy materials near the top of the ladder without interference of the stiles.

Another object is to provide a ladder fixture which will not interfere with normal usage of a ladder when attached thereto; which will provide a visual guide for leaning the ladder at a predetermined angle; and which will securely wedge beneath the rain gutter or soffet of a building and provide a high friction force against side slip.

Still another object is to provide a ladder fixture which can be quickly and easily transposed for different uses without additional components.

A further object is to provide a single ladder fixture configuration which can be attached to ladders with or without hollow rungs; which is constructed of relatively few parts of simple design; and which is inexpensive to manufacture and easy to assemble.

Briefly, these and other objects and novel features of the invention are accomplished by a two-position fixture which includes two cantilevered brackets having symmetrically opposed elongate channels along one edge of each formed to be clamped about the sides of a ladder by a rod extending through the stiles and a selected rung, or across the exterior of the ladder. The sides of the channels are slightly tapered inward to securely grip the stiles when the brackets are drawn toward each other by threaded fasteners on the ends of the rod.

In the upright position clamped to a forwardly inclined ladder, the brackets project forwardly from the stiles in planes normal to the rungs. The upper edges form an acute angle with the stiles such that the edges are horizontal when the ladder is leaned at the OSHA-recommended angle. The forward edge of each bracket forms a right angle with the upper edge. A padded board extending across the brackets and removably connected thereto is positionable in one of two positions. In the one position the board is locked against the upper edges of the bracket for bridging the ladder over fragile materials, such as roof tiles, or a rain gutter, or for supporting heavy structural materials, such as panels or windows, near the top of the ladder; and in the other position the board is locked against the forward edges for leaning the ladder against a vertical surface.

Other objects, advantages and novel features of the invention will also become apparent from the following detailed description when considered in conjunction with the accompanying drawings wherein:

BRIEF DESCRIPTION OF THE DRAWINGS

FIG. 1 is an elevation view of a ladder fixture according to the invention clamped to an aluminum ladder for bridging a roof gutter;

FIG. 2 is an enlarged isometric view of the fixture in FIG. 1;

FIG. 5 is another cross sectional view of the fixture taken along the line 5—5 of FIG. 2;

DESCRIPTION OF THE PREFERRED EMBODIMENT

Figure 6:
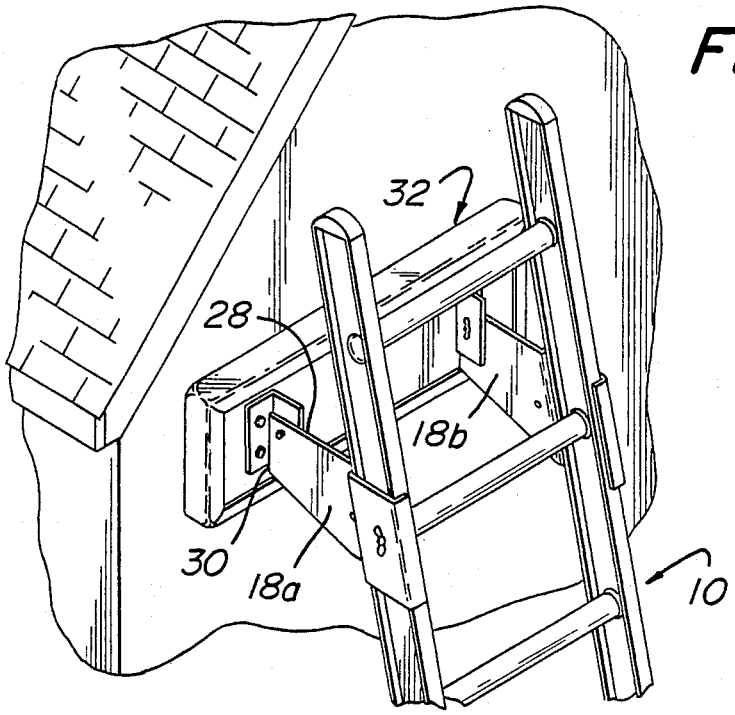
FIG. 6 is an enlarged isometric view of the ladder fixture FIG. 1 repositioned for leaning against the side of a building.

Referring now to the drawings wherein like reference characters designate like or corresponding parts throughout the several views, there is shown in FIGS. 1 and 2 a ladder 10 extending above the roof edge of a building with a fixture, generally designated by the reference number 12, attached near the top and projecting into contact with the exposed surface of a fascia F directly beneath a rain gutter G. The ladder is leaning forwardly at the OSHA recommended angle of 75½ degrees above the horizontal plane. Ladder 12, such as of metal or glass fiber construction, includes hollow rungs 14 extending through rib-like stiles 16. Fixture 12 includes a pair of left and right brackets 18*a* and 18*b*, preferably of high strength lightweight metal such as an aluminum alloy, with symmetrically opposed elongated channels 20*a* and 20*b* for receiving the outer sides of stiles 16. A rod 24 extends through a selected rung 14 and aligned holes 26 in channels 20*a* and 20*b*. Wing nuts 22 threaded on the ends of rod 24 enable brackets 18*a* and 18*b* to be tightly clamped by hand about ladder 10. The sides of channels 20*a* and 20*b* are tapered slightly inwardly to grip the stiles 16 securely against movement as brackets 18*a* and 18*b* are drawn toward each other by wing nuts 22. For example, as shown in FIG. 5, channel 20*a* has been constructed with a 1/32 inch taper on both sides for receiving a 3-inch nominal width stile.

Figure 3:
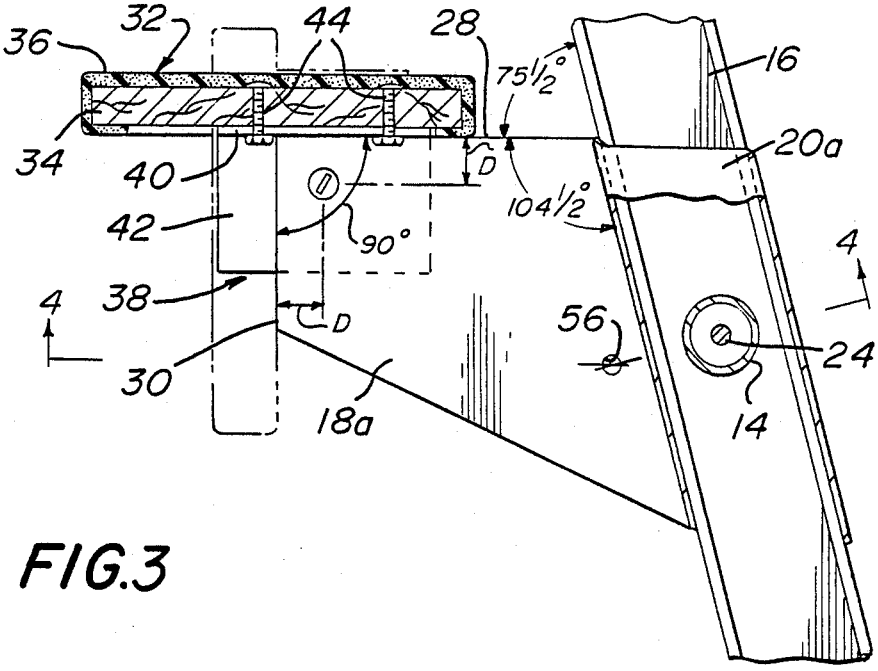
FIG. 3 is a side, view partially in cross section of the fixture taken along the line 3—3 of FIG. 2.
Figure 4:
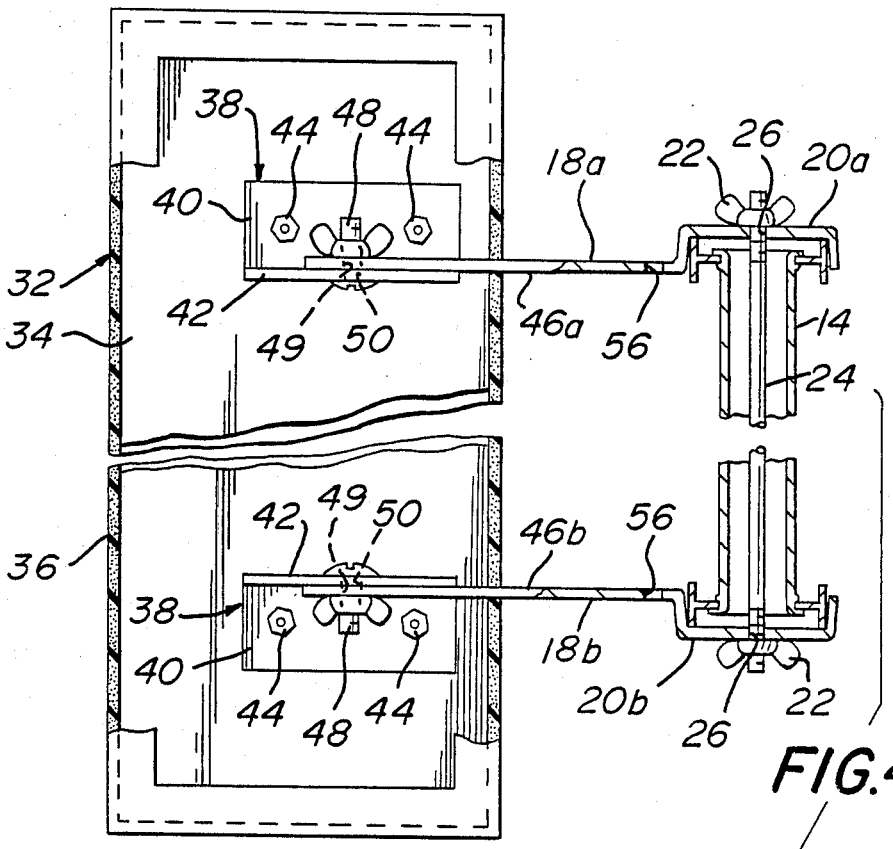
FIG. 4 is a bottom view of the fixture taken along the line 4—4 of FIG. 3.

Bracket 18*b* is identical to bracket 18*a* except for the channels as noted below. Referring to FIGS. 3 and 4, bracket 18*a* includes a cantilevered arm defined by an upper edge 28 extending from the channel 20*a* at an obtuse angle of 104½ degrees with the length of the channel 20*a* This angle is the supplementary angle to the OSHA-recommended leaning angle of 75½ degrees above the horizontal. Consequently, when ladder 10 is leaned at the recommended angle, the support surface 28 is horizontal. The outer or forward edge 30 defining the forward end of bracket 18*a* extends downwardly at 90 degrees from edge 28, and is vertical when the ladder is leaned at the recommended angle.

A cross member 32, preferably constructed of a rigid board 34 and covered around the edges and on one side with a resilient non-slip pad 36 such as plastic foam, is connected across brackets 18*a* and 18*b* near their forward ends by a pair of angles 38 each having legs 40 and 42 normal to each other. Legs 40 are disposed in parallel to each other on the exposed side of board 34 by nut and bolt fasteners 44, the distance between angles 38 being selected to ensure that brackets 18*a* and 18*b* remain substantially parallel when attached to the ladder. Legs 42 are contiguously secured to the confronting inner sides 46*a* and 46*b* of brackets 18*a* and 18*b* with legs 40 projecting outwardly between board 34 and edges 28 or 30 and hand-tightened by wing nuts and bolts 48 through apertures 49 and 50 in legs 40 and 42, respectively. The positioning of apertures 49 and 50 in brackets 18*a* and 18*b* and legs 42 is critical to a rigid attachment. The distance D, FIG. 3, between each fastener 48 and the adjacent upper and forward edges 28 and 30, and between each fastener 48 and the adjacent leg 40, must be substantially equal. This ensures legs 40 remain contiguous with either of the bracket surfaces 28 and 30 to prevent cross member 32 from rotating when in use. Legs 40 also provide a relatively hard bearing surface between edges 28 and 30 and the exposed board 34 for preventing the edges from wearing a groove in the board and allowing it to rotate freely.

For gaining access to a roof where there is a protecting rain gutter G mounted along fascia F exposed directly beneath the rain gutter, a fixture 12 of a size suitable for the ladder 10 is pre-assembled with the cross member 32 connected across brackets 18*a* and 18*b* with angles 38 abutting upper edges 28. Channels 20*a* and 20*b* are then positioned along the stiles 16 for aligning holes 26 with a selected hollow rung 14 which will be located slightly below the rain gutter when ladder 10 is leaned at the recommended angle. Rod 22 is placed through the rung 14 and holes 26 and secured with wing nuts 26. Ladder 10 may now be raised into place with the forward padded edge of the member 3 contacting the fascia and the broad padded surface contacting the underside of the gutter G. It may be possible, especially where there is firm ground support beneath the ladder, to literally wedge the ladder and fixture beneath the rain gutter further reducing any risk of side slip. In some structures fascia F exposed directly beneath the rain gutter G diminishes due to the gutter's slope, leaving insufficient surface for the forward edge of cross member 32 to contact. It may be preferable in such instances to position cross member 32 with angles 38 against the forward edge 30 of brackets 18*a* and 18*b* as shown in FIG. 6 and allow broad padded surface to lean against an exterior wall. Obviously, the extent of roof overhang and exposed fascia will dictate which position is best and safest.

Figure 7:
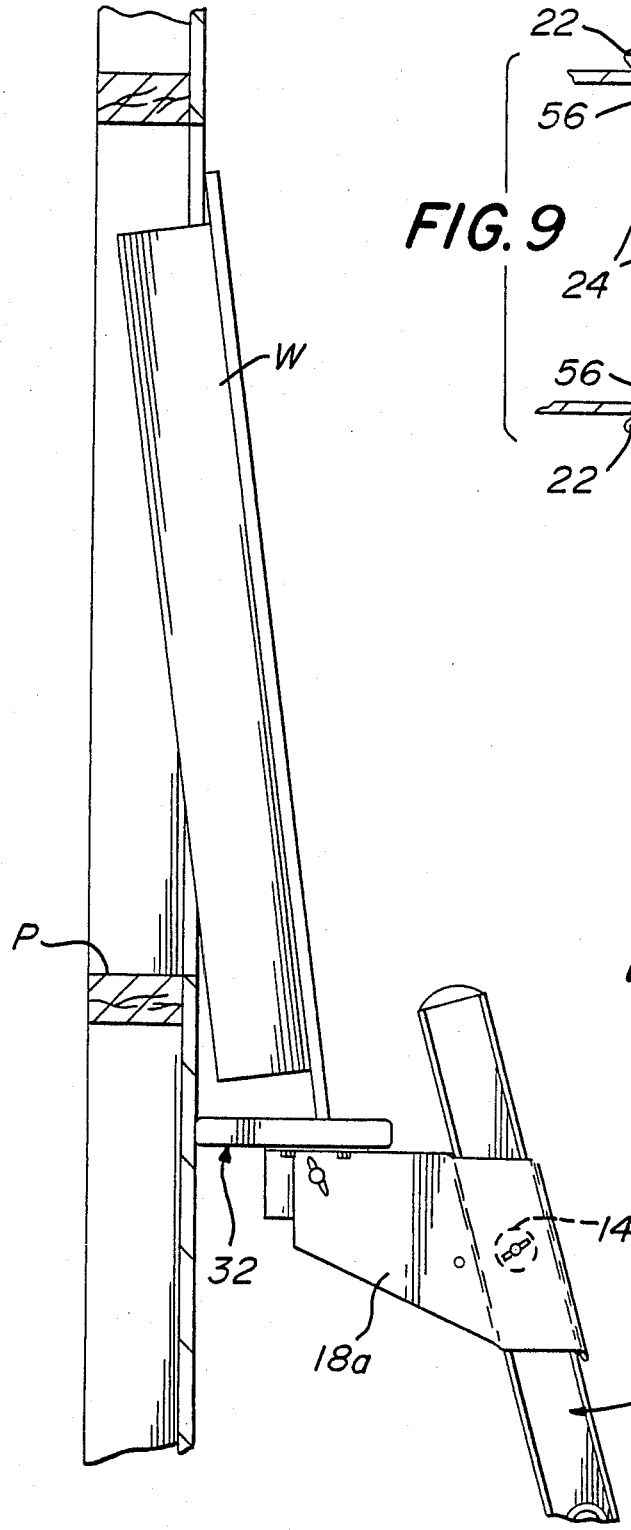
FIG. 7 is an elevation view of the ladder fixture of FIG. 1 clamped to a ladder and supporting a window during installation in an elevated opening.

For installing heavy building structures such as window or panel in an elevated opening P of a building, as shown in FIG. 7, brackets 18*a* and 18*b* are clamped to stiles 16 by rod 22 passing through the topmost rung 14, and cross member 32 is positioned against the upper edges 28 of brackets 18*a* and 18*b*. With the top of ladder 10 leaned against the building near the bottom of the opening, a window W may be pushed up the ladder and over the top to allow it to rest on the broad padded surface of cross member 32 until the user, with assistance of another if necessary, is ready to place the window in opening P.

Figure 8:
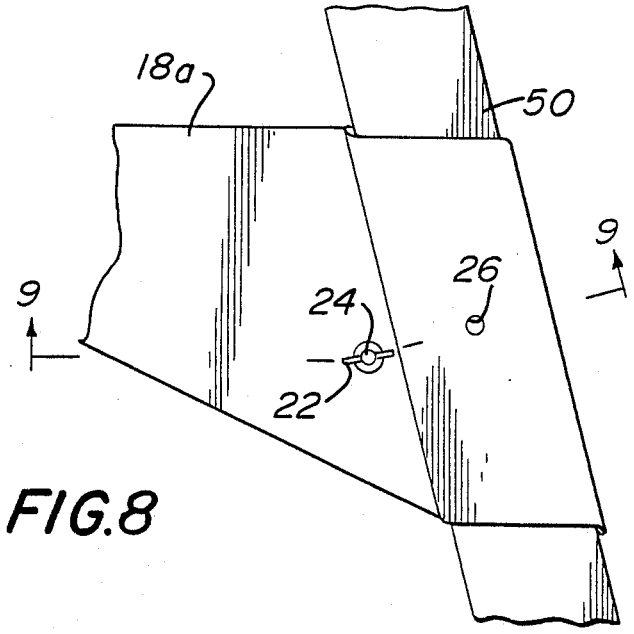
FIG 8 is a fragmentary side view of the fixture according to the invention clamped to a wooden ladder.
Figure 9:
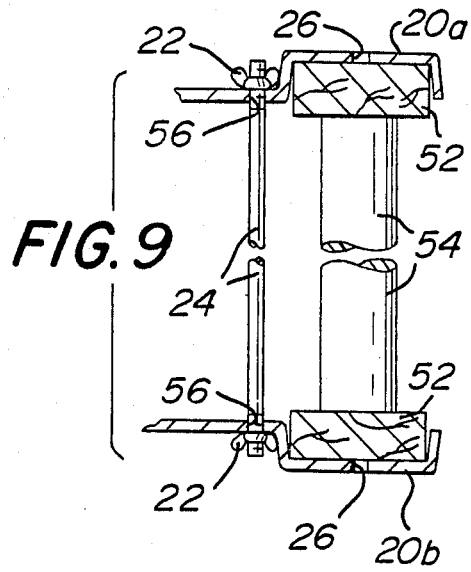
FIG. 9 is a cross sectional view of the fixture taken along the line 9—9 of FIG. 8.

It will be noted that utilizing a hollow rung of the ladder for clamping rod 22 has the added advantage of preventing brackets 18*a* and 18*b* from slipping along the length of stiles 16. However, this feature is not available when the fixture 12 is attached to a conventional wooden ladder having solid stiles 52 and rungs 54. Referring to FIGS. 8 and 9, aligned holes 56 in brackets 18*a* and 18*b* located adjacent to the forward side of channels 20*a* and 20*b* receive cross rod 24, and fasteners 22 clamp brackets 18*a* and 18*b* about the outer sides of the ladder stiles 52. This adaptation for fixture 12 is not suitable for heavy vertical loadings due to the possible sliding of bracket 18*a* and 18*b* along the stiles 16. However, with adequate tapering of the sides of channels 20*a* and 20*b*, as described above, and a sufficient clamping force, it may be used for light loads.

Accordingly, some of the many advantages and novel features of the invention should now be readily apparent. For instance, a ladder fixture with a two-position cross member is described which offers several uses with no addition of parts. In the one position, it enables a ladder to extend above an overhanging roof while bridging any roof tiles or weak rain gutters. In the same position, the fixture also enables a worker to rest a heavy panel or window at the top of the ladder just below an elevated opening before its installation. In the other position, the fixture enables a ladder to be leaned against weak aluminum or vinyl siding. In either position, the fixture provides the user with a visual guide when the ladder is leaning at the OSHA-recommended safe angle. The fixture is also capable of being used with wooden ladders, and can be quickly assembled and disassembled by hand and without tools.

It will be understood that various changes in the details, steps and arrangement of parts, which have been herein described and illustrated in order to explain the nature of the invention, may be made by those skilled in the art within the principle and scope of the invention as expressed in the appended claims.

What is claimed is:

1. A multipurpose fixture for a ladder comprising, in combination:

a pair of juxtapositioned brackets each including symmetrically opposite elongated channel means for engaging the outer sides of the ladder stiles, and support means extending from said channel means having a first edge at an obtuse angle with the length thereof for bearing a vertical load and a second edge normal to said first edge for bearing a lateral load, said obtuse angle being supplementary to a predetermined leaning angle of the ladder;

securing means coupled to said brackets for clamping said channel means about the stiles engaged therein; and transverse means operatively connected to said brackets for selectively positioning against said first or second edge.

2. A fixture according to claim 1 wherein:

said securing means includes a rod extending between said brackets, and a first fastener at one end of said rod for engaging said channel means about the stiles.

3. A fixture according to claim 2 wherein:

said brackets include a first aperture positioned in each of said channel means for aligning with a hollow rung in the ladder; and said rod extends through said first apertures and for passing through the hollow rung, and said first fasteners clamp said brackets to the stiles at either end of said rod.

4. A fixture according to claim 2 wherein:

said brackets include a first aperture positioned in each of said support means adjacent to said channel means; and said rod extends through said first apertures for extending across the exterior of the ladder, and first fasteners for clamping said brackets to the stiles.

5. A fixture according to claim 4 wherein:

said brackets include a second aperture positioned in each of said channel means for aligning with a hollow rung in the ladder; and said rod is selectably removable from the hollow rung for extending across the exterior of the ladder adjacent to said channel means.

6. A fixture according to claim 1 wherein:

said obtuse angle is substantially 104½ degrees.

7. A fixture according to claim 1 wherein:

said transverse means includes a flat crossbar with one side connected to said brackets, and a resilient pad contiguously fixed to the other side and the long edges of said crossbar.

8. A fixture according to claim 1 wherein:

said support means includes first apertures disposed a preselected distance from said first and second edges; and said transverse means includes a crossbar, a pair of angles with each having a first leg and second leg orthogonal to each other, said first legs secured to said crossbar and said second legs contiguous with respective ones of said support means and each having a second aperture disposed said preselected distance from said first leg, and first fasteners extending through said first and second apertures for fixing said angles to said support means in one of the selected positions.

9. A fixture according to claim 8 wherein:

said first leg of each of said angles is interposed between said member and the upper edge or forward edge of said support member.

10. A two-position fixture for supporting a forwardly inclined ladder with hollow rungs a spaced distance from an upright surface, comprising, in combination:

a pair of brackets each having an elongated channel for engaging opposite outer sides of the ladder at a selected rung, and a cantilever extending forwardly from said channel having an upper edge at an obtuse angle with the length of said channel, and a forward edge extending downwardly at a right angle from said upper edge, said obtuse angle being supplementary to a predetermined leaning angle of the ladder;

a rod secured at its ends to said channels for extending through the selected rung and clamping said brackets to the ladder; and a crossbar operatively connected on one side to respective forward ends of said cantilevers for selectively engaging said upper edge or said forward edge.

11. A fixture according to claim 10 further comprising:

first fasteners threadingly connected to the ends of said rod for engaging said channel means about the stiles.

12. A fixture according to claim 11 wherein:

said brackets include a first aperture positioned in each of said channels for aligning with a hollow rung in the ladder; and said rod extends through said first apertures and for passing through the hollow rung.

13. A fixture according to claim 10 wherein:

said brackets include a first aperture positioned in each of said cantilevers adjacent to said channel; and said rod extends through said first apertures for extending across the exterior of the ladder.

14. A fixture according to claim 13 wherein:

said brackets include a second aperture positioned in each of said channels for aligning with a hollow rung in the ladder; and said rod is selectably removable from the hollow rung for extending across the exterior of the ladder adjacent to said channels.

15. A fixture according to claim 10 wherein:

said obtuse angle is substantially 104½ degrees.

16. A fixture according to claim 10 further comprising:

a resilient pad contiguously fixed to the other side and the long edges of said crossbar.

17. A fixture according to claim 10 further comprising:

said cantilever having first apertures disposed a preselected distance from said upper and forward edges thereof; and a pair of angles with each having a first leg and a second leg orthogonal to each other, said first legs secured to said crossbar and said second legs contiguous with respective ones of said cantilevers and each having a second aperture disposed said preselected distance from said first leg, and first fasteners extending through said first and second apertures for fixing said angles to said cantilever in one of the selected positions.

18. A fixture according to claim 17 wherein:

said first leg of each of said angles is interposed between said crossbar and the upper edge or forward edge of said cantilever.

* * * * *